US005078236A

United States Patent [19]

Shimoaki et al.

[11] Patent Number: 5,078,236

[45] Date of Patent: Jan. 7, 1992

[54] POWER UNIT FOR HYDRAULIC ELEVATOR

[75] Inventors: Motoo Shimoaki; Yoshio Kamiya; Yukihiro Takigawa; Hiroshi Usida; Tatsuro Miyake, all of Inazawa, Japan

[73] Assignee: Mitsubishi Denki Kabushiki Kaisha, Japan

[21] Appl. No.: 588,740

[22] Filed: Sep. 27, 1990

[30] Foreign Application Priority Data

Sep. 29, 1989 [JP] Japan ..... 1-252083

[51] Int. Cl.[5] ..... B66B 9/04

[52] U.S. Cl. ..... 187/110

[58] Field of Search ..... 187/110, 111, 17

*Primary Examiner*—J. R. Scott
*Assistant Examiner*—Lawrence E. Colbert
*Attorney, Agent, or Firm*—Leydig, Voit & Mayer

[57] ABSTRACT

A hydraulic elevator power unit has an oiltight type detector for detecting the number of revolutions of an electric motor. A leak oil hole formed in a lower end portion of the detector is connected to a leak oil tank. The operating oil entering the detector is discharged through the leak oil hole, thereby preventing the detecting portion from being immersed in the operating oil.

5 Claims, 3 Drawing Sheets

POWER UNIT FOR HYDRAULIC ELEVATOR

BACKGROUND OF THE INVENTION

1. FIELD OF THE INVENTION

This invention relates to a power unit for hydraulic elevators and, more particularly, to a hydraulic elevator power unit in which an electric motor and a hydraulic pump driven by this electric motor are submerged in an operating oil contained in an oil reservoir.

2. DESCRIPTION OF THE RELATED ART

A submerged type power unit such as the ones disclosed in Japanese Patent Laid-Open Nos. 62-275986 and 64-34881 are known in which an electric motor and a hydraulic pump are submerged in an operating oil in an oil reservoir. In this type of power unit, a detector for detecting the number of revolutions of the electric motor is also submerged in the operating oil. FIG. 1 is a schematic sectional side view of a conventional hydraulic elevator power unit. As shown in FIG. 1, an electric motor 3, a hydraulic pump 4 and a detector 10 connected to an end of the shaft of the electric motor 3 are submerged in an operating oil 2 contained in an oil reservoir 1. A hydraulic valve 6 disposed outside the oil reservoir 1 is connected to the hydraulic pump 4 by a discharge pipe 5, and a hydraulic jack 7 is connected to the hydraulic valve 6 by a piping 8. A cage 9 of the elevator is connected to the hydraulic jack 7.

The thus-constructed power unit is operated as described below. For upward movement of the cage 9, the operating oil 2 is supplied to the hydraulic jack 7 through the hydraulic valve 6 by the hydraulic pump 4, thereby moving the cage 9 upward. For downward movement of the cage 9, the operating oil 2 is made to return to the interior of the oil reservoir 1 through the hydraulic valve 6 and the hydraulic pump 4, thereby moving the cage 9 downward.

The cage traveling control is performed by detecting the number of revolutions of the electric motor 3 with the detector 10.

In this conventional hydraulic elevator power unit, an oil seal or an 0 ring is used to prevent the operating oil from entering the detector, since the detector is submerged in the operating oil. However, a very small amount of operating oil enters the detector through the oil seal and so on as the electric motor shaft is rotated. If the amount of entering oil becomes substantially large, there is a risk of the detecting portion being immersed in the operating oil and, hence, a risk of malfunction of the detector

SUMMARY OF THE INVENTION

The present invention has been achieved to solve this problem, and an object of the present invention is to provide a power unit for a hydraulic elevator capable of preventing the operating oil from entering the detecting portion of the detector.

To this end, the present invention provides a power unit for a hydraulic elevator, comprising: an electric motor; a hydraulic pump driven by the electric motor; an oiltight detector attached to an end of a shaft of the electric motor for detecting the number of revolutions of the electric motor; a reservoir containing an operating oil in which the electric motor, the hydraulic pump and the detector are disposed so as to be submerged in the operating oil; a leak oil hole formed in a bottom portion of the detector; and a leak oil tank connected to the leak oil hole.

These and other features of the present invention will become apparent from the following description taken in conjunction with the accompanying drawings.

DESCRIPTION OF THE PREFERRED EMBODIMENTS

Figure 2:
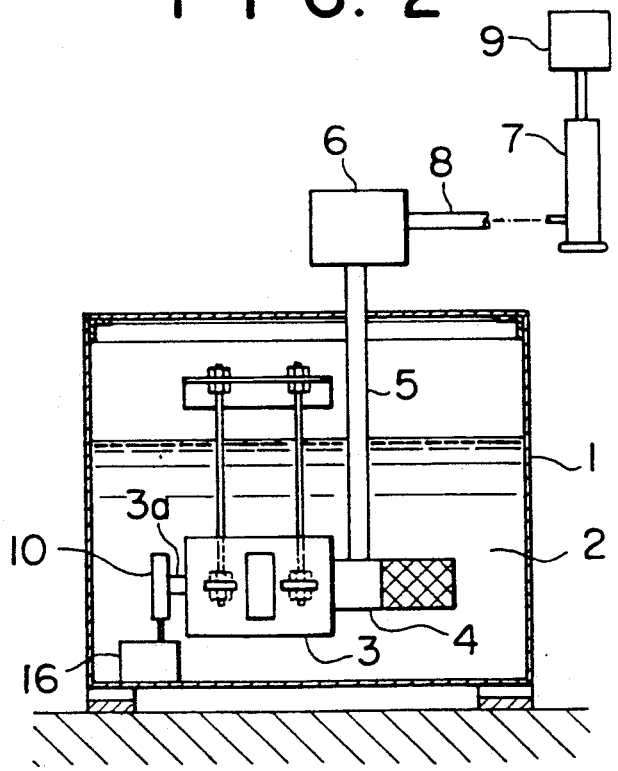
FIG. 2 is a schematic sectional side view of a hydraulic elevator power unit according to an embodiment of the present invention.
Figure 3:
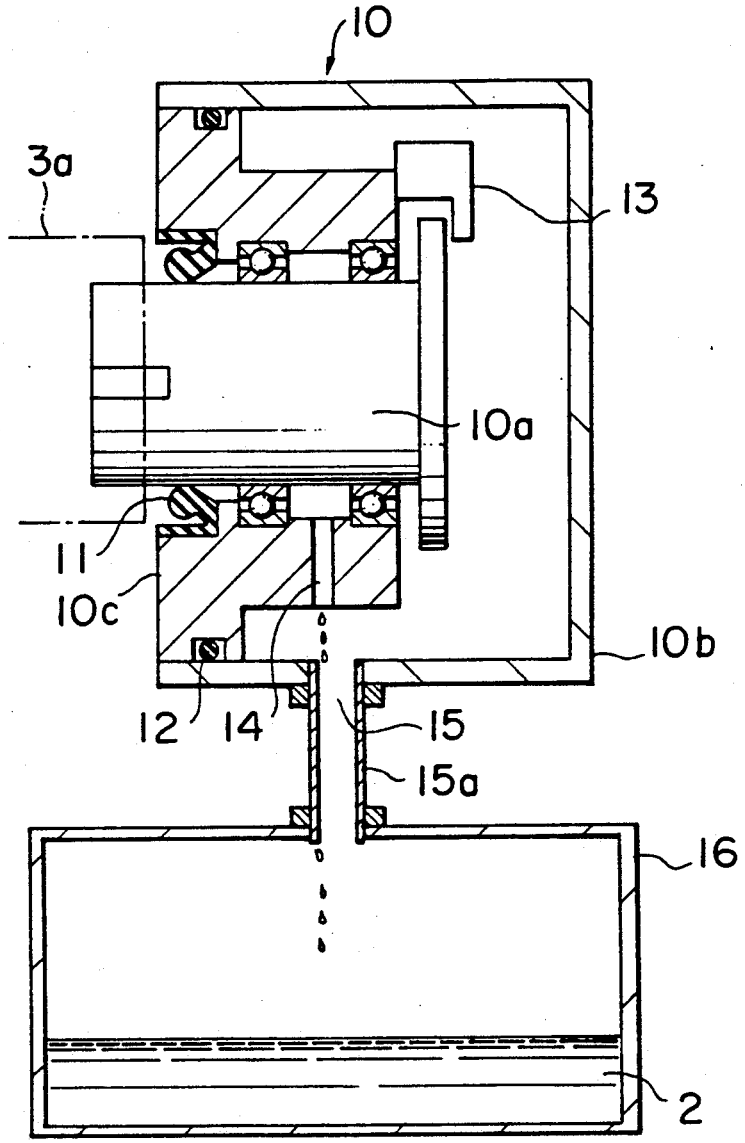
FIG. 3 is a sectional side view of an essential portion of the power unit shown in FIG. 2.

FIG. 2 is a schematic sectional side view of a hydraulic elevator in accordance with an embodiment of the present invention, and FIG. 3 is a schematic sectional side view of a detector used for the elevator shown in FIG. 2. As shown in these figures, a detector 10 connected to an end 3*a* of a shaft of an electric motor 3 has an oil seal 11 provided at its rotary portion 10*a*, and an O ring 12 interposed between a case 10*b* and a bearing portion 10*c* to close the case in an oiltight manner. A detecting portion 13 is connected to the rotary portion 10*a*. An oil passage 14 is formed in the bearing portion 10*c*. A leak oil hole 15 is formed in a bottom portion of the case 10*b* and is connected to a leak oil tank 16 by a connecting pipe 15*a*.

Figure 1:
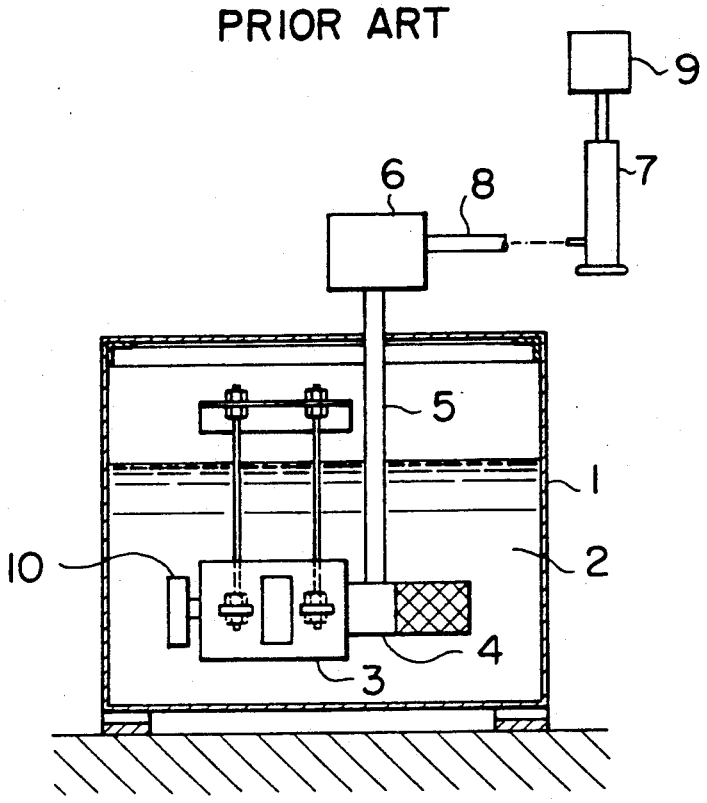
FIG. 1 PRIOR ART
FIG. 1 is a schematic sectional side view of a conventional hydraulic elevator power unit.

The operation of supplying and returning the operating oil for upward and downward movements of a cage 9 is the same as that described above with respect to the conventional power unit shown in FIG. 1, and the description for this operation will not be repeated.

In this embodiment, even if the amount of operating oil 2 entering the detector 10 becomes large, the operating oil which has entered the detector 10 is discharged through a bottom portion of the case 10*b* to prevent the detecting portion 13 from being immersed in the operating oil 2, thereby preventing a malfunction of the detector 10. The leak oil tank 16 has a capacity larger than that of the detector 10. The effect of this construction is therefore ensured even if the rate at which the operating oil 2 enters the detector 10 is large.

Figure 4:
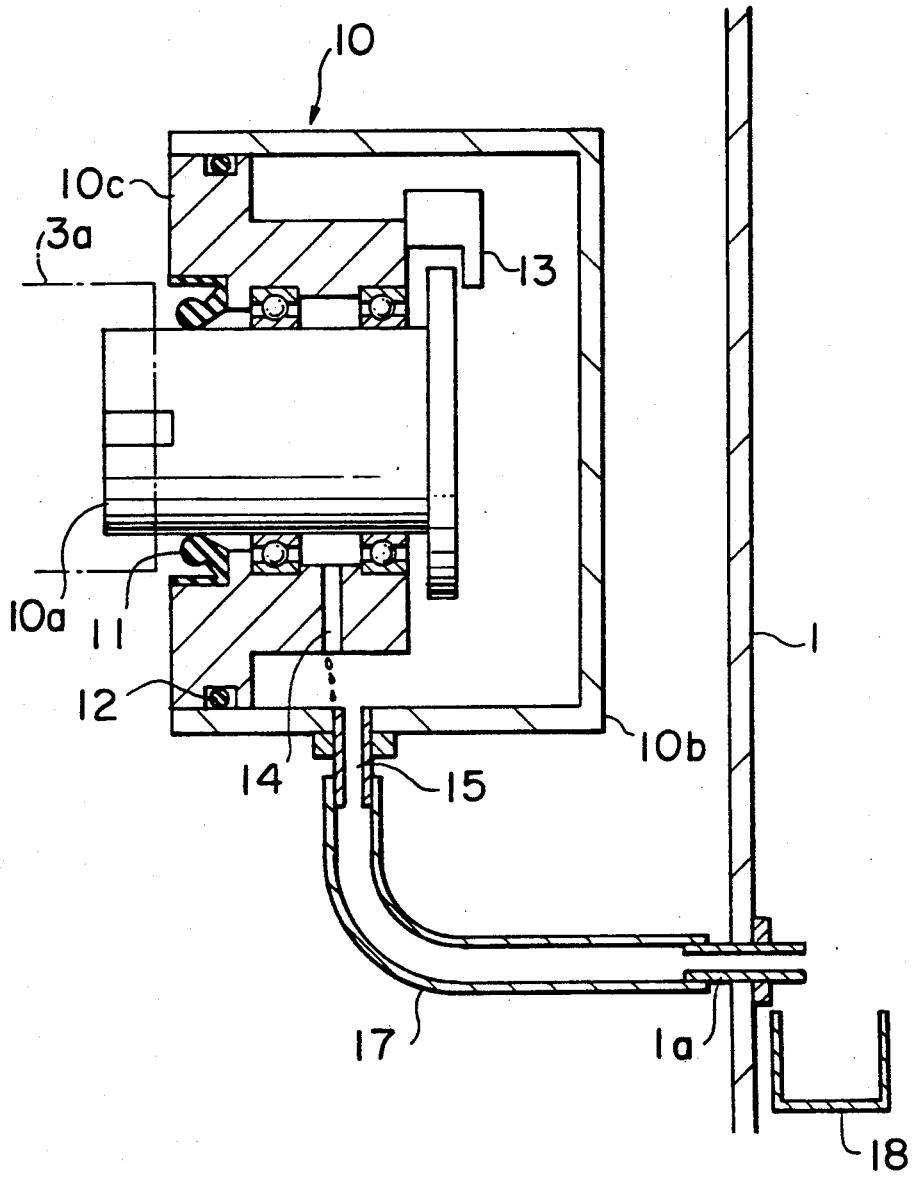
FIG. 4 is a sectional side view of an essential portion of a power unit according to another embodiment of the present invention.

FIG. 4 is a sectional side view of a power unit which represents another embodiment of the present invention, showing essential portions thereof. As shown in FIG. 4, an outlet 1*a* formed in an oil reservoir 1 and a leak oil hole 15 are connected to a flexible pipe 17 to lead the oil entering the detector 10 to a leak oil basin 18 disposed outside the oil reservoir 1. Preferably, the oil leak basin 18 is opened to the atmosphere. Except for these components, the construction of this embodiment is the same as that shown in FIGS. 2 and 3. In this case, the operating oil 2 which has entered the detector 10 is collected outside the oil reservoir 1. It is therefore possible to cope with a situation where the amount of collected operating oil is abruptly increased.

What is claimed is:

1. A power unit for a hydraulic elevator, comprising:

an electric motor;

a hydraulic pump driven by said electric motor;

an oiltight detector attached to an end of a shaft of said electric motor for detecting the number of revolutions of said electric motor;

a reservoir containing an operating oil in which said electric motor, said hydraulic pump and said detector are disposed so as to be submerged in said operating oil;

a leak oil hole formed in a bottom portion of said detector; and a leak oil tank connected to said leak oil hole.

2. A power unit according to claim 1 wherein said leak oil tank is disposed below said oil leak hole.

3. A power unit according to claim 2 wherein said leak oil tank is opened to the atmosphere.

4. A power unit according to claim 1 wherein said leak oil tank is disposed outside said reservoir.

5. A power unit according to claim 4 wherein said leak oil tank is opened to the atmosphere.

* * * * *